US009803643B2

(12) United States Patent
Ohno et al.

(10) Patent No.: US 9,803,643 B2
(45) Date of Patent: Oct. 31, 2017

(54) SCROLL-TYPE COMPRESSOR

(71) Applicants: DENSO CORPORATION, Kariya, Aichi-pref. (JP); NIPPON SOKEN, INC., Nishio, Aichi-pref. (JP)

(72) Inventors: Yuichi Ohno, Nishio (JP); Kazuhide Uchida, Nishio (JP); Masashi Higashiyama, Kariya (JP)

(73) Assignees: DENSO CORPORATION, Kariya, Aichi-pref. (JP); SOKEN, INC., Nishio, Aichi-pref. (JP)

( * ) Notice: Subject to any disclaimer, the term of this patent is extended or adjusted under 35 U.S.C. 154(b) by 19 days.

(21) Appl. No.: 15/029,299

(22) PCT Filed: Oct. 10, 2014

(86) PCT No.: PCT/JP2014/005168

§ 371 (c)(1),
(2) Date: Apr. 14, 2016

(87) PCT Pub. No.: WO2015/056432

PCT Pub. Date: Apr. 23, 2015

(65) Prior Publication Data

US 2016/0222965 A1 Aug. 4, 2016

(30) Foreign Application Priority Data

Oct. 18, 2013 (JP) ..... 2013-217072

(51) Int. Cl.
*F01C 1/063* (2006.01)
*F03C 2/00* (2006.01)
(Continued)

(52) U.S. Cl.
CPC ..... *F04C 28/20* (2013.01); *F04C 18/0215* (2013.01); *F04C 18/0223* (2013.01);
(Continued)

(58) Field of Classification Search
CPC ..... F04C 18/0215; F04C 18/0223; F04C 18/0269; F04C 23/001; F04C 23/008;
(Continued)

(56) References Cited

U.S. PATENT DOCUMENTS 5,775,893 A * 7/1998 Takao ..... F04C 23/008 418/60
6,758,659 B2 * 7/2004 Ni ..... F04C 23/008 418/60

FOREIGN PATENT DOCUMENTS

JP 62067288 A * 3/1987 ..... F04C 18/0223
JP 06200885 A * 7/1994 ..... F04C 18/02
(Continued)

*Primary Examiner* — Theresa Trieu
(74) *Attorney, Agent, or Firm* — Harness, Dickey & Pierce, P.L.C.

(57) ABSTRACT

A scroll-type compressor includes: a movable scroll including a low-stage movable tooth portion having a spiral shape and protruding from a first side of a movable substrate portion in an axial direction, and a high-stage movable tooth portion having a spiral shape and protruding from a second side of the movable substrate portion in the axial direction; and a shaft arranged to extend through the movable substrate portion and causing the movable scroll to undergo revolution motion. A low-stage compression mechanism and a high-stage movable compression mechanism are provided on opposite sides of the movable substrate portion in the axial direction. The numbers of curling of the low-stage movable tooth portion and the high-stage movable tooth portion are set to be one.

9 Claims, 6 Drawing Sheets

(51) Int. Cl.

| | |
|---|---|
| ***F03C 4/00*** | (2006.01) |
| ***F04C 2/00*** | (2006.01) |
| ***F04C 28/20*** | (2006.01) |
| ***F04C 23/00*** | (2006.01) |
| ***F04C 18/02*** | (2006.01) |
| ***F04C 29/12*** | (2006.01) |
| *F04C 29/00* | (2006.01) |

(52) U.S. Cl.
CPC ..... *F04C 23/001* (2013.01); *F04C 29/12* (2013.01); *F04C 18/0269* (2013.01); *F04C 23/008* (2013.01); *F04C 29/0057* (2013.01)

(58) Field of Classification Search
CPC ..... F04C 28/20; F04C 29/0057; F04C 29/12; F01C 1/0269; F01C 1/0238
USPC ..... 418/55.1–55.6, 57, 60, 94
See application file for complete search history.

(56) References Cited

FOREIGN PATENT DOCUMENTS

| | | | | | |
|---|---|---|---|---|---|
| JP | H07091384 | A | | 4/1995 | |
| JP | H08170592 | A | | 7/1996 | |
| JP | 2000314368 | A | | 11/2000 | |
| JP | 2014013005 | A | * | 1/2014 | ..... F04C 23/008 |

* cited by examiner

TOTAL TORQUE VARIATION
TORQUE VARIATION DUE TO HIGHER-PRESSURE COMPRESSION ROOM VH
TORQUE VARIATION DUE TO LOWER-PRESSURE COMPRESSION ROOM VL

TOTAL TORQUE VARIATION
TORQUE VARIATION DUE TO HIGHER-PRESSURE COMPRESSION ROOM VH
TORQUE VARIATION DUE TO LOWER-PRESSURE COMPRESSION ROOM VL

SCROLL-TYPE COMPRESSOR

CROSS REFERENCE TO RELATED APPLICATIONS

This application is a U.S. National Phase Application under 35 U.S.C. 371 of International Application No. PCT/JP2014/005168 filed on Oct. 10, 2014 and published in Japanese as WO 2015/056432 A1 on Apr. 23, 2015. This application is based on and claims the benefit of priority from Japanese Patent Application No. 2013-217072 filed on Oct. 18, 2013. The entire disclosures of all of the above applications are incorporated herein by reference.

TECHNICAL FIELD

The present disclosure relates to a scroll-type compressor that pressurizes a fluid in multiple stages.

BACKGROUND ART

Conventionally, in Patent Document 1, a scroll-type compressor is disclosed as a compressor used for a so-called gas injection cycle (economizer refrigeration cycle), and includes a low-stage scroll compression mechanism (hereinafter, described as a low-stage compression mechanism), and a high-stage scroll compression mechanism (hereinafter, described as a high-stage compression mechanism). The compressor pressurizes a refrigerant (fluid) in multiple stages in these multiple compression mechanisms.

Like the scroll-type compressor of Patent Document 1, in a compressor including multiple compression mechanisms, a size of the compressor is likely to be large as a whole. With respect to this, the scroll-type compressor of Patent Document 1 adopts a movable scroll in which a spiral-shaped tooth portion is provided on both side of a flat-shaped substrate portion in an axial direction. Since a low-stage compression mechanism and a high-stage compression mechanism are positioned in proximity to the opposite sides of the movable scroll in the axial direction, the size of the compressor is reduced as a whole.

Further, in the scroll-type compressor of Patent Document 1, a rotation shaft which transmits a rotational drive force to the movable scroll is disposed to penetrate through a center part of the movable scroll, and both end parts of the rotation shafts are supported rotatably.

In such configuration where the both end sides of the rotation shaft is rotatably supported, a largest rotation rate below which the rotation shaft is rotatable stably can be increased more than a configuration where only a one side of the rotation shaft is rotatably supported. Hence, a maximum volume of a compression chamber of each compression mechanism required for discharging a fluid at a desired flow rate can be decreased, and thus the size can be further reduced.

However, like the scroll-type compressor of Patent Document 1, in the configuration where the rotation shaft extends through the center part of the movable scroll, an energy loss may increase as a whole.

In more detail, in a general scroll compression mechanism in which a rotation shaft does not extend through a center part of a movable scroll, multiple crescent-shaped compression spaces are provided in a gap between a spiral-shaped movable tooth portion provided on the movable scroll and a spiral-shaped fixed tooth portion provided on a fixed scroll when viewed in an axial direction of the rotation shaft. The multiple crescent-shaped compression spaces constitute a compression chamber.

Moreover, these multiple compression spaces are positioned symmetrically with respect to a shaft center of the rotation shaft, and swirl and shift from a radially outer side to a radially inner side with reducing in volume in accordance with revolution motion of the movable scroll. When two compression spaces provided at positions symmetric about the shaft center move to an innermost side (shaft center side), the two compression spaces communicates with each other, and fluid compressed in the two compression spaces is discharged from a discharge hole provided on a center part of the fixed scroll.

However, like the scroll-type compressor of Patent Document 1, in a configuration where a rotation shaft is disposed to extend through a center part of a movable scroll, two compression spaces cannot be made to communicate with each other, or a discharge hole cannot be provided on a center part. Thus, in order to discharge fluids pressurized in respective compression spaces, the fluids pressurized in the respective compression spaces have to be joined together before the multiple compression spaces move to the shaft center side.

In this case, if a pressure difference is generated between the fluids pressurized in the respective compression spaces, the fluid may flow backward from a high-pressure side compression space to a low-pressure side compression space, and an energy loss of the compressor may increase. To limit the backward flow, if a special communication passage or the like, through which the respective compression spaces communicate with each other when fluid pressures in the multiple compression spaces becomes equivalent to each other, is provided, an inner configuration inside the compressor may become complicated.

PRIOR ART DOCUMENT

Patent Document

Patent Document 1: JP H08-170592 A

SUMMARY OF THE INVENTION

In consideration of the above-described points, it is an objective of the present disclosure to limit increase in energy loss with simple configuration in a scroll-type compressor that pressurizes fluid in multiple stages.

According to a first aspect of the present disclosure, a scroll-type compressor includes a rotation shaft, a movable scroll, a low-stage fixed scroll, a high-stage fixed scroll, a low-stage compression chamber and a high-stage compression chamber. The rotation shaft rotates by receiving a drive force from a rotational drive source. The movable scroll revolves by a rotational drive force transmitted from the rotation shaft. The movable scroll includes a movable substrate portion having a flat-plate shape, a low-stage movable tooth portion having a spiral shape and protruding from the movable substrate portion to a first side in an axial direction of the rotation shaft, and a high-stage movable tooth portion having a spiral shape and protruding from the movable substrate portion to a second side in the axial direction of the rotation shaft. The low-stage fixed scroll includes a low-stage substrate portion having a flat-plate shape, and a low-stage fixed tooth portion having a spiral shape, protruding from the low-stage substrate portion in the axial direction of the rotation shaft and engaging with the low-stage movable tooth portion. The high-stage fixed scroll includes a high-stage substrate portion having a flat-plate shape, and a high-stage fixed tooth portion having a spiral shape, protruding from the high-stage substrate portion in the axial direction of the rotation shaft and engaging with the high-stage movable tooth portion. The low-stage compression chamber is a space provided between the low-stage movable tooth portion and the low-stage fixed tooth portion. The low-stage compression chamber changes in volume in accordance with revolution of the movable scroll to pressurize a fluid sucked from an outside. The high-stage compression chamber is a space provided between the high-stage movable tooth portion and the high-stage fixed tooth portion. The high-stage compression chamber changes in volume in accordance with revolution of the movable scroll to pressurize the fluid pressurized in the low-stage compression chamber. The rotation shaft extends through the movable substrate portion, and a number of curling of at least one of the low-stage movable tooth portion and the high-stage movable tooth portion is less than or equal to one.

Accordingly, since the number of curling of at least one of the low-stage movable tooth portion and the high-stage movable tooth portion is less than or equal to one, a compression chamber defined by a movable tooth portion that is selected from among the low-stage movable tooth portion and the high-stage movable tooth portion and is less than or equal to one in the number of curling can be constituted by a single space.

Since a fluid is discharged from the single space of the compression chamber, it is unnecessary to combine fluids pressurized in multiple spaces. Hence, increase in energy loss generated at the time of combining the fluids which are different in pressure from each other can be limited certainly.

In the scroll-type compressor which pressurizes a fluid in multiple stages, without adding a special communication passage through which multiple compression spaces communicate with each other, the increase in energy loss can be reduced with simple configuration.

Further, then number of curling of both the low-stage movable tooth portion and the high-stage movable tooth portion. Hence, increase in energy loss in both the low-stage movable tooth portion and the high-stage movable tooth portion can be reduced.

"The number of curling" of a tooth portion means a range where a part of the tooth portion defining a compression space (compression chamber) and contributing pressurization is provided, and the number of curling is one when the range is one circle (360°). The "number of curling" may be also referred to as a "lap number".

Further, "the number of curling is less than or equal to one" means not only that the range of the spiral-shaped tooth portion is exactly less than or equal to 360°, but also that the range is slightly more than 360° due to an error in processing of the tooth portion or residual part in the processing.

According to a second aspect of the present disclosure, a scroll-type compressor includes a rotation shaft, a movable scroll, a low-stage fixed scroll, a high-stage fixed scroll, a low-stage compression chamber and a high-stage compression chamber. The rotation shaft rotates by receiving a drive force from a rotational drive source. The movable scroll revolves by a rotational drive force transmitted from the rotation shaft. The movable scroll includes a movable substrate portion having a flat-plate shape, a low-stage movable tooth portion having a spiral shape and protruding from the movable substrate portion to a first side in an axial direction of the rotation shaft, and a high-stage movable tooth portion having a spiral shape and protruding from the movable substrate portion to a second side in the axial direction of the rotation shaft. The low-stage fixed scroll includes a low-stage substrate portion having a flat-plate shape, and a low-stage fixed tooth portion having a spiral shape, protruding from the low-stage substrate portion in the axial direction of the rotation shaft and engaging with the low-stage movable tooth portion. The high-stage fixed scroll includes a high-stage substrate portion having a flat-plate shape, and a high-stage fixed tooth portion having a spiral shape, protruding from the high-stage substrate portion in the axial direction of the rotation shaft and engaging with the high-stage movable tooth portion. The low-stage compression chamber is a space provided between the low-stage movable tooth portion and the low-stage fixed tooth portion. The low-stage compression chamber changes in volume in accordance with revolution of the movable scroll to pressurize a fluid sucked from an outside. The high-stage compression chamber is a space provided between the high-stage movable tooth portion and the high-stage fixed tooth portion. The high-stage compression chamber changes in volume in accordance with revolution of the movable scroll to pressurize the fluid pressurized in the low-stage compression chamber. The rotation shaft extends through the movable substrate portion, and at least one of the low-stage compression chamber and the high-stage compression chamber has a single space communicating with a discharge hole at a time of communicating with the discharge hole through which a fluid is discharged from an inside of each compression chamber.

Accordingly, since at least one of the low-stage compression chamber and the high-stage compression chamber has the single space communicating with the discharge hole at the time of communicating with the discharge hole through which a fluid is discharged from the inside of each compression chamber, similar to the first embodiment, the increase in energy loss can be limited certainly.

In the scroll-type compressor which pressurizes a fluid in multiple stages, without adding a special communication passage through which multiple compression spaces communicate with each other, the increase in energy loss can be reduced with simple configuration.

Moreover, each of the low-stage compression chamber and the high-stage compression chamber may have a single space communicating with the intermediate-pressure discharge hole or the high-pressure discharge hole when the each compression chamber communicates with the intermediate-pressure discharge hole or the high-pressure discharge hole. Accordingly, the increase in energy loss can be limited certainly in both the low-stage compression chamber and the high-stage compression chamber.

"When communicating with the discharge hole, the compression chamber is constituted by a single space" does not mean that "when communicating with the discharge hole, the compression chamber is always constituted by a single space", but means that "when communicating with the discharge hole, the compression chamber is at least temporarily constituted by a single space". Therefore, when communicating with the discharge hole, the compression chamber may be constituted by multiple compression spaces temporarily in accordance with the rotation of the rotation shaft.

EMBODIMENTS FOR EXPLOITATION OF THE INVENTION

Figure 1:
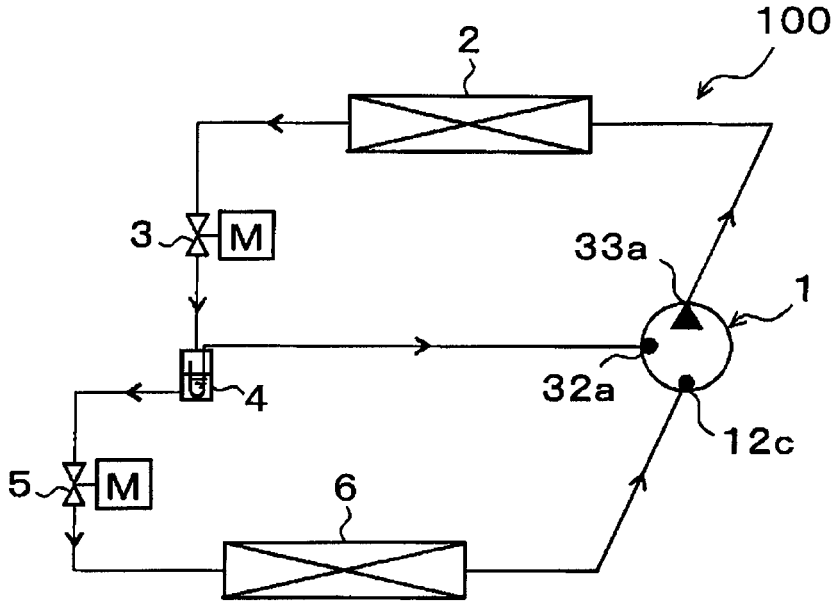
FIG. 1 is an entire configuration diagram of a refrigeration cycle according to an embodiment of the present disclosure.

An embodiment of the present disclosure will be described below with reference to drawings. A multiple-stage pressurization scroll-type compressor 1 (hereinafter, described just as a compressor 1) according to the present embodiment is used for a refrigeration cycle 100 shown in an entire configuration diagram of FIG. 1. The refrigeration cycle 100 in an air conditioner fulfills a function to heat a blown air that is blown to an air-conditioning target space.

More specifically, the refrigeration cycle 100 of the present embodiment is a vapor-compression refrigeration cycle, which includes a compressor 1 that compresses and discharges a refrigerant, a radiator 2 that heats the blown air via heat exchange between a high-pressure refrigerant discharged from the compressor 1 and the blown air, a high-stage expansion valve 3 that depressurizes a refrigerant flowing out of the radiator 2 to be an intermediate-pressure refrigerant, a gas-liquid separator 4 that separates gas and liquid of the intermediate-pressure refrigerant depressurized in the high-stage expansion valve 3, a low-stage expansion valve 5 that depressurizes a liquid-phase refrigerant separated in the gas-liquid separator 4 to be a low-pressure refrigerant, and an evaporator 6 that evaporates the low-pressure refrigerant via heat exchange between the low-pressure refrigerant depressurized in the low-stage expansion valve 5 and outside air.

Further, in the refrigeration cycle 100 of the present embodiment, a gas-phase refrigerant separated in the gas-liquid separator 4 is drawn into an intermediate-pressure suction port 32*a* of the compressor, and the low-pressure refrigerant flowing out of the evaporator 6 is drawn into a low-pressure suction port 12*c* of the compressor 1. Thus, the refrigeration cycle 100 of the present embodiment is configured as a gas injection cycle in which an intermediate-pressure refrigerant generated in the cycle (more specifically, depressurized in the high-stage expansion valve 3) is joined with an intermediate-pressure refrigerant that is being compressed in the compressor 1.

The refrigeration cycle 100 uses a HFC series refrigerant (e.g., R134a) as the refrigerant, and constitutes a subcritical refrigeration cycle in which a pressure of the high-pressure refrigerant does not exceed a subcritical pressure of the refrigerant. A HFO series refrigerant (e.g., R1234yf) may be used as the refrigerant. Additionally, refrigerator oil (oil) is mixed with the refrigerant to lubricate sliding portions in the compressor 1, and a part of the refrigerator oil circulates together with the refrigerant in the cycle.

Next, referring to FIGS. 2 to 4, a detailed configuration of the compressor 1 of the present embodiment will be described. The upward and downward arrows shown in the sectional diagram perpendicular to an axial direction of FIG. 2 represent, respectively, upward and downward directions in a state where the compressor 1 is installed in the refrigeration cycle 100.

The compressor 1 includes a compression mechanism portion 10 that draws, compresses and discharges the refrigerant, an electric motor portion 20 that is a rotational drive source outputting a rotational drive force, and a shaft 25 that is a rotation shaft rotating by receiving the rotational drive force from the electric motor portion 20 and transmitting the rotational drive force to the compression mechanism portion 10. The compressor 1 is an electric compressor in which these components are integrated through a housing 30 used as an outer shell of the compressor 1. The compressor 1 of the present embodiment is, as shown in FIG. 2, configured as a so-called transverse-mounted type in which the shaft 25 extends in an approximately horizontal direction in the state where the compressor 1 is installed in the refrigeration cycle 100.

Figure 2:
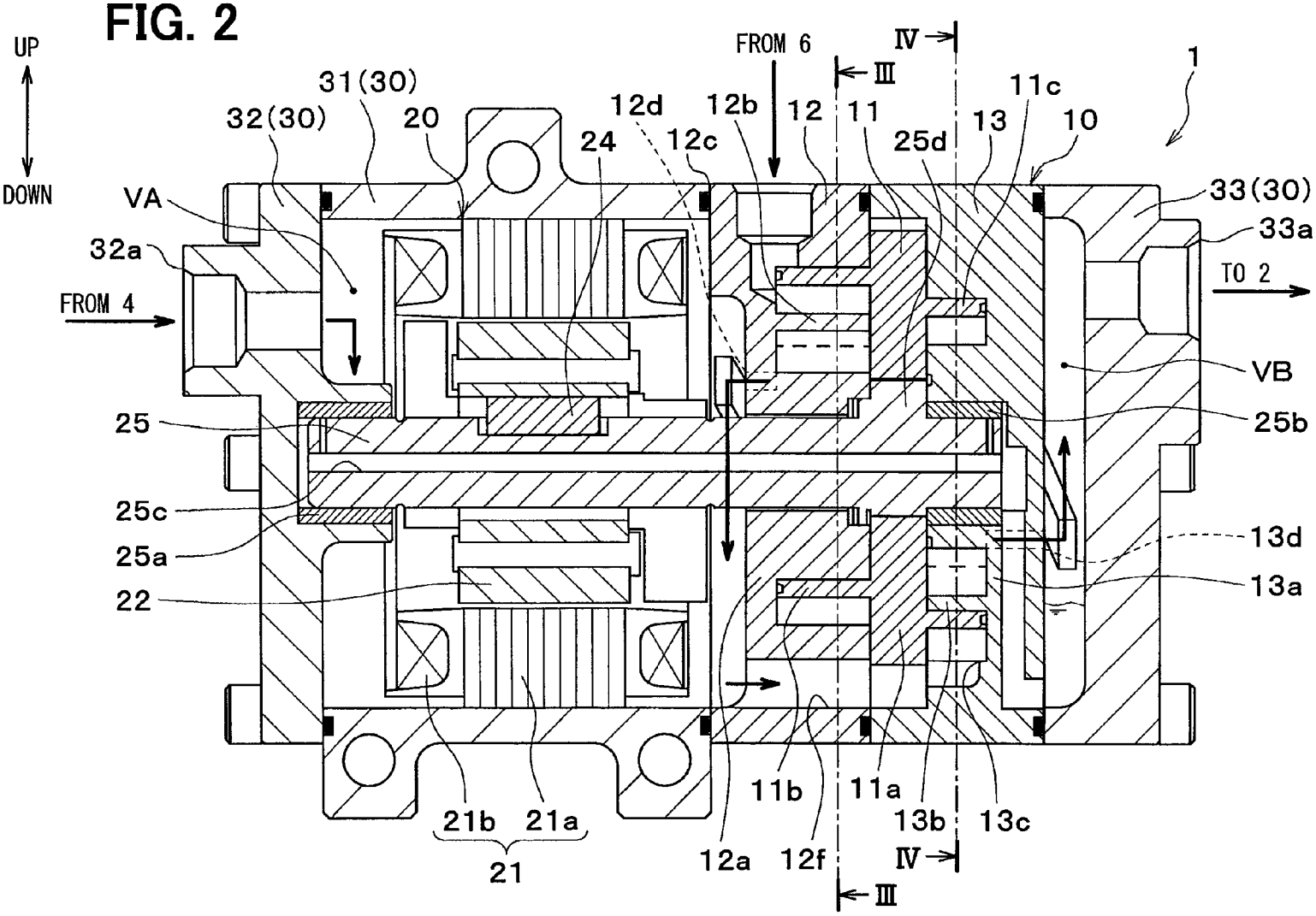
FIG. 2 is a sectional diagram parallel to an axial direction of a compressor according to the embodiment.

The housing 30 includes a cylindrical member 31 extending in the horizontal direction, and a motor-side lid member 32 closing an opening part of the cylindrical member 31 on a first side in the axial direction (i.e. on an opposite side from the compression mechanism portion 10 in FIG. 2). Further, an opening part of the cylindrical member 31 on a second side in the axial direction (i.e. on a side facing to the compression mechanism portion 10 in FIG. 2) is closed by a below-described low-stage fixed scroll 12 of the compression mechanism portion 10.

A sealing member made of an O-ring is disposed in a contact portion between the cylindrical member 31 and the motor-side lid member 32 and in a contact portion between the cylindrical member 31 and the low-stage fixed scroll 12, and the refrigerant does not leak from these contact portions. Accordingly, an accommodation room VA that houses the electric motor portion 20 is provided on a radially inner side of the cylindrical member 31. Further, the motor-side lid member 32 has the intermediate-pressure suction port 32*a* through which the gas-phase refrigerant separated in the gas-liquid separator 4 flows in an inside of the accommodation room VA.

The electric motor portion 20 includes a stator 21 that constitutes a fixed armature, and a rotor 22 that constitutes a rotatable armature. The stator 21 is configured by a stator core 21*a* made of a magnetic material, and a stator coil 21*b* wound around the stator core 21*a*. A supply of electric power to the stator coil 21*b* causes a rotating magnetic field that makes the rotor 22 rotate.

The rotor 22 is configured to include a permanent magnet and is disposed on a radially inner side of the stator 21. The rotor 22 has a circular cylindrical shape extending in a rotation-axis direction of the rotor 22. The shaft 25 extending in the rotation-axis direction is fixed into a shaft-center hole of the rotor 22. Hence, when the rotating magnetic field is generated due to the supply of electric power to the stator coil 21*b*, the rotor 22 and the shaft 25 rotate as one.

In the present embodiment, a key 24 is fitted into a key groove provided in the shaft 25 and the rotor 22, and accordingly the shaft 25 and the rotor 22 are fixed, but the shaft 25 and the rotor 22 may be fixed by a method such as press-fitting.

The shaft 25 is longer than the rotor 22 in length in the axial direction, and an end part of the shaft 25 on a first side in the axial direction is rotatably supported by an electric-motor-side bearing portion 25*a* positioned in a center part of the motor-side lid member 32. On the other hand, a second side of the shaft 25 in the axial direction extends through the compression mechanism portion 10 and is rotatably supported by a compression-mechanism-side bearing portion 25*b* positioned in a center part of a below-described high-stage fixed scroll 13 of the compression mechanism portion 10.

The shaft 25 includes therein an oil supply passage 25*c* for introducing the refrigerator oil to the sliding portions. The refrigerator oil is supplied through the oil supply passage 25*c* to a sliding portion between the shaft 25 and the electric-motor-side bearing portion 25*a* and a sliding portion between the shaft 25 and the compression-mechanism-side bearing portion 25*b*. The electric-motor-side bearing portion 25*a* and the compression-mechanism-side bearing portion 25*b* may employ a rolling bearing or a sliding bearing.

Next, the compression mechanism portion 10 includes a movable scroll 11 revolving due to the rotational drive force transmitted from the shaft 25, the low-stage fixed scroll 12 having a low-stage fixed tooth portion 12*b* engaging with a low-stage movable tooth portion 11*b* of the movable scroll 11, and the high-stage fixed scroll 13 a high-stage fixed tooth portion 13*b* engaging with a high-stage movable tooth portion 11*c* of the movable scroll 11.

More specifically, the movable scroll 11 includes a movable substrate portion 11*a* having an approximately circular-plate shape spreading perpendicular to the axial direction of the shaft 25. The low-stage movable tooth portion 11*b*, which has a spiral shape and protruding toward the first side in the axial direction (i.e. toward the electric motor portion 20 in FIG. 2), and the high-stage movable tooth portion 11*c*, which has a spiral shape and protruding from the movable substrate portion 11*a* toward the second side in the axial direction (i.e. opposite from the electric motor portion 20 in FIG. 2), are provided on the movable substrate portion 11*a*.

A through-hole extending through the movable substrate portion 11*a* is provided in the center part of the movable scroll 11, and an eccentric portion 25*d* provided on the shaft 25 and eccentric from the center axis is slidably inserted into the through-hole.

The low-stage fixed scroll 12 is positioned on the first side of the movable scroll 11 in the axial direction, and has a low-stage substrate portion 12*a* having an approximately circular-plate shape spreading perpendicular to the axial direction of the shaft 25. The low-stage fixed tooth portion 12*b* having a spiral shape and protruding toward the second side in the axial direction to engage with the low-stage movable tooth portion 11*b* is provided on the low-stage substrate portion 12*a*. More specifically, the low-stage fixed tooth portion 12*b* is provided by an inner surface of a scroll groove portion into which the low-stage movable tooth portion 11*b* is fitted.

A center part of the low-stage fixed scroll 12 has a through-hole extending through the low-stage substrate portion 12*a*, and a portion of the shaft 25 on the first side of the eccentric portion 25*d* in the axial direction is inserted into the through-hole.

The high-stage fixed scroll 13 is positioned on the second side of the movable scroll 11 in the axial direction, and has a high-stage substrate portion 13*a* having a plate shape spreading perpendicular to the axial direction of the shaft 25. The high-stage fixed tooth portion 13*b* having a spiral shape and protruding to the first side in the axial direction to engage with the high-stage movable tooth portion 11*c* is provided in the high-stage substrate portion 13*a*. More specifically, the high-stage fixed tooth portion 13*b* is provided by an inner surface of a scroll groove portion into which the high-stage movable tooth portion 11*c* is fitted.

The above-described compression-mechanism-side bearing portion 25*b* is positioned in a center part of the high-stage fixed scroll 13, and an end part of the shaft 25 on the second side of the eccentric portion 25*d* in the axial direction is rotatably supported.

Therefore, in the compression mechanism portion 10 of the present embodiment, the low-stage fixed scroll 12, the movable scroll 11 and the high-stage fixed scroll 13 are arranged in this order from the first side to the second side of the shaft 25 (i.e. from the electric motor portion 20 to the compression mechanism portion 10 in FIG. 2). Further, the shaft 25 is disposed to extend through the center parts of the low-stage fixed scroll 12 and the movable scroll 11.

Moreover, in the present embodiment, a non-shown rotation preventing mechanism that prevents rotation of the movable scroll 11 about the eccentric portion 25*d* is provided between the movable scroll 11 and the low-stage fixed scroll 12. Thus, when the shaft 25 rotates, the movable scroll 11 does not rotate about the eccentric portion 25*d* and revolves about a revolution center that is the rotation center of the shaft 25.

Accordingly, the compression mechanism portion 10 of the present embodiment has two scroll compression mechanisms. In other words, the movable scroll 11 and the low-stage fixed scroll 12 provide a low-stage scroll compression mechanism (low-stage compression mechanism), and the movable scroll 11 and the high-stage fixed scroll 13 provide a high-stage scroll compression mechanism (high-stage compression mechanism).

More specifically, in the low-stage compression mechanism, the low-stage movable tooth portion 11*b* of the movable scroll 11 and the low-stage fixed tooth portion 12*b* of the low-stage fixed scroll 12 engage with each other, and contact at multiple positions. According to this, as shown in FIG. 3, a crescent-shaped low-stage compression space is provided when viewed along the rotation axis direction. The low-stage compression space changes in volume in accordance with the revolution motion of the movable scroll 11, and is used as an example of a low-stage compression chamber VL in which the low-pressure refrigerant is compressed to be the intermediate-pressure refrigerant.

Figure 3:
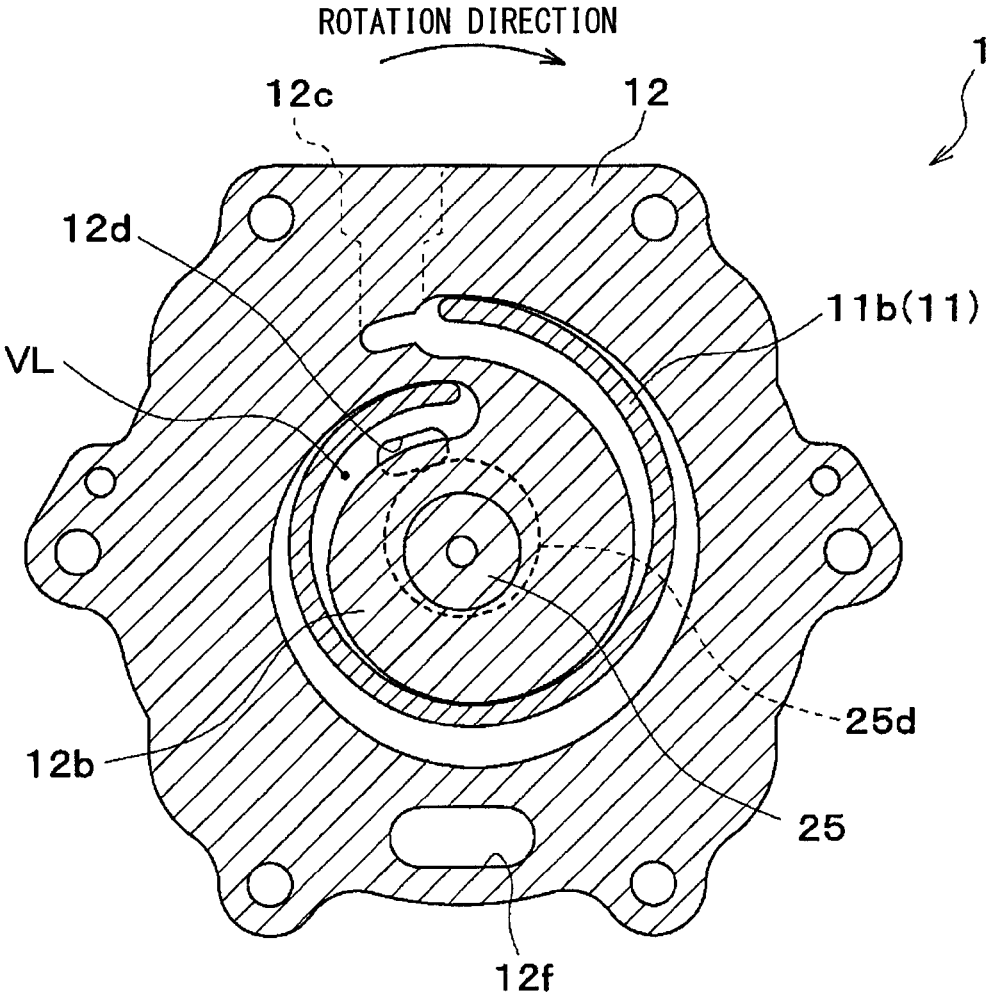
FIG. 3 is a sectional diagram taken along a line III-III of FIG. 2.

In the present embodiment, as shown in FIG. 3, the number of curling of the low-stage movable tooth portion 11*b* is one. The low-stage movable tooth portion 11*b* curled to cover a range slightly larger than one circle (360°) is shown in FIG. 3. However, one in the number of curling in the present embodiment means that the number of curling of a range of the low-stage movable tooth portion 11*b*, in which a part actually defining a compression space (compression chamber) and contributing pressurization is provided, is one.

A radially outer portion of the low-stage fixed scroll 12 includes the low-pressure suction port 12*c* through which the low-pressure refrigerant flowing out of the evaporator 6 is drawn. The low-pressure suction port 12*c* is positioned to communicate with the low-stage compression chamber when a volume of the low-stage compression chamber is largest.

When the low-stage fixed scroll 12 is viewed in the axial direction, the low-stage fixed scroll 12 includes an intermediate-pressure discharge hole 12*d* at a position on a radially outer side of the shaft 25 and a radially inner side of a radially innermost part (curling start part) of the low-stage movable tooth portion 11*b*. The intermediate-pressure refrigerant compressed in the low-stage compression chamber VL is discharged through the intermediate-pressure discharge hole 12*d* to the accommodation chamber VA provided on the radially outer side of the cylindrical member 31 of the housing 30.

Hence, the accommodation chamber VA fulfills a function of a space housing the above-described electric motor portion 20 and fulfills a function of a space absorbing pressure pulsation of the intermediate-pressure refrigerant flowing out of the intermediate-pressure discharge hole 12*d*. Further, a reed valve is disposed in an outlet part of the intermediate-pressure discharge hole 12*d* to prevent a counter flow of the refrigerant from the accommodation chamber VA to the low-stage compression chamber VL.

On the other hand, in the high-stage compression mechanism, the high-stage movable tooth portion 11*c* of the movable scroll 11 and the high-stage fixed tooth portion 13*b* of the high-stage fixed scroll 13 engage with each other, and contact at multiple positions. According to this, as shown in FIG. 4, a crescent-shaped high-stage compression space is provided when viewed along the rotation axis direction. The high-stage compression space changes in volume in accordance with the revolution motion of the movable scroll 11, and is used as an example of a high-stage compression chamber VH in which the intermediate-pressure refrigerant is compressed to be the high-pressure refrigerant.

Figure 4:
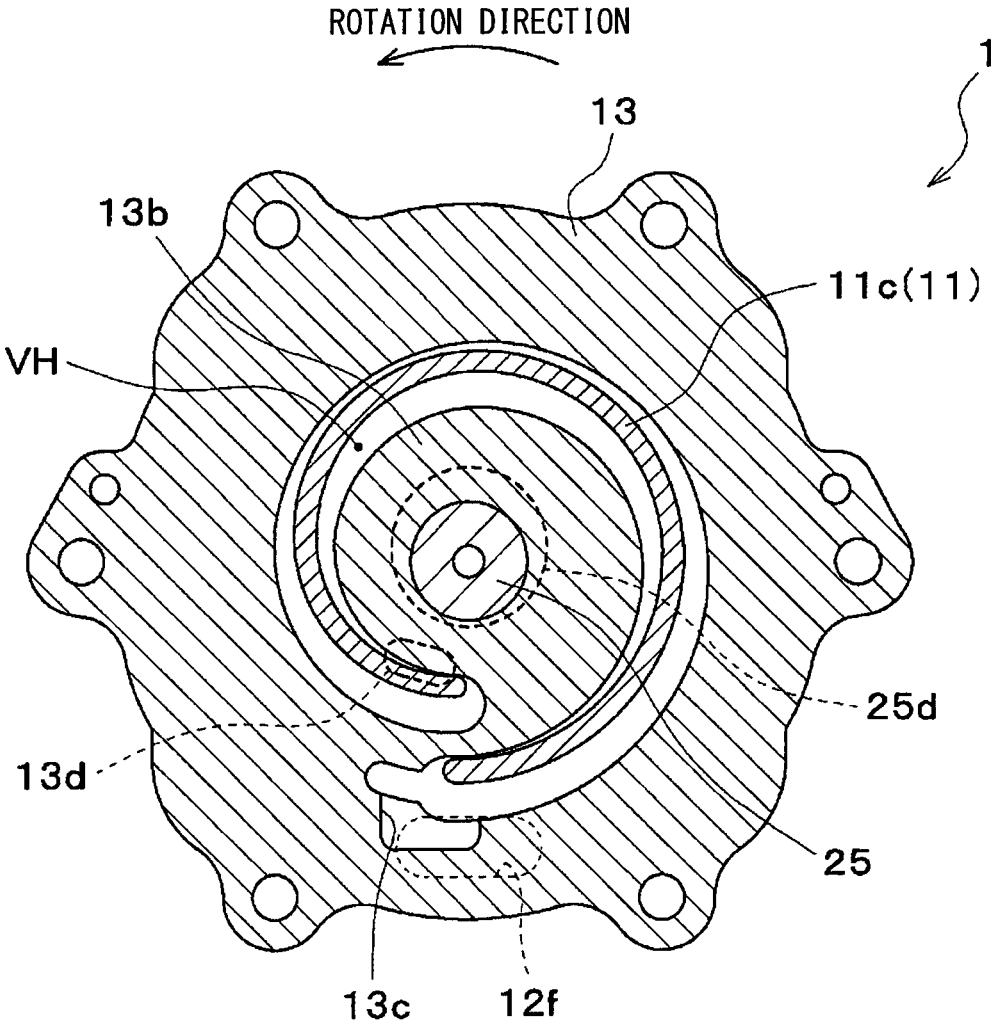
FIG. 4 is a sectional diagram taken along a line IV-IV of FIG. 2.

In the present embodiment, as shown in FIG. 4, the number of curling of the high-stage movable tooth portion 11*c* is one, similar to the low-stage movable tooth portion 11*b*.

In the preset embodiment, as shown in FIG. 2, dimensions in the axial direction (i.e. degrees of protruding from each substrate portion) of the high-stage movable tooth portion 11*c* and the high-stage fixed tooth portion 13*b* are shorter than dimensions in the axial direction (i.e. degrees of protruding from each substrate portion) of the low-stage movable tooth portion 11*b* and the low-stage fixed tooth portion 12*b*. Accordingly, a volume ratio between the volume of the high-stage compression chamber VH and the volume of the low-stage compression chamber VL is adjusted such that a coefficient of performance (COP) of the refrigeration cycle 100 approaches a local maximum value.

The low-stage movable tooth portion 11*b* and the high-stage movable tooth portion 11*c* of the present embodiment are arranged such that a variation amplitude of a total torque variation obtained by summing a torque variation generated in the shaft 25 due to a pressure variation of refrigerant in the low-stage compression chamber VL and a torque variation generated in the shaft 25 due to a pressure variation of refrigerant in the high-stage compression chamber VH becomes smaller than that in a case where the low-stage movable tooth portion 11*b* and the high-stage movable tooth portion 11*c* are arranged to be in the same phase when viewed in the axial direction of the shaft 25 (i.e. curling start parts on the radially inner side and curling end parts on the radially outer side of the tooth portions 11*b* and 11*c* are overlapped with each other, respectively, when viewed in the axial direction).

In other words, the low-stage movable tooth portion 11*b* and the high-stage movable tooth portion 11*c* are displaced from each other in a circumferential direction with respect to the center axis to be arranged in a different phase when viewed in the axial direction of the rotation axis, so that the variation amplitude of the total torque variation approaches a minimum value. More specifically, as shown in the sectional diagrams of FIGS. 3 and 4, the low-stage movable tooth portion 11*b* and the high-stage movable tooth portion 11*c* are shifted from each other by a phase of 180° in the circumferential direction with respect to the center axis.

A radially outer portion of the high-stage fixed scroll 13 includes the intermediate-pressure suction port 13*c*. The intermediate-pressure refrigerant in the accommodation chamber VA is drawn into the high-stage compression chamber VH through an intermediate-pressure refrigerant passage 12*f*, which extends through the low-stage substrate portion 12*a* of the low-stage fixed scroll 12, and the intermediate-pressure suction port 13*c*. The intermediate-pressure suction port 13*c* is positioned to communicate with the high-stage compression chamber when a volume of the high-stage compression chamber is largest.

When the high-stage fixed scroll 13 is viewed in the axial direction, the high-stage fixed scroll 13 includes a high-pressure discharge hole 13*d* at a position on the radially outer side of the shaft 25 and a radially inner side of a radially innermost part (curling start part) of the high-stage fixed tooth portion 13*b*. The high-pressure refrigerant compressed in the high-stage compression chamber VH is discharged through the high-pressure discharge hole 13*d* to a discharge chamber VB. A reed valve is disposed in an outlet part of the high-pressure discharge hole 13*d* to prevent a counter flow of the refrigerant to the high-stage compression chamber VH.

The discharge chamber VB is provided in a gap between the second side of the high-stage fixed scroll 13 in the axial direction (an opposite side from the movable scroll 11 in FIG. 2) and a compression-mechanism-side lid member 33 located on the second side of the high-stage fixed scroll 13 in the axial direction. The compression-mechanism-side lid member 33 is one of components constituting the housing 30. The compression-mechanism-side lid member 33 includes a high-pressure discharge port 33*a* through which the high-pressure refrigerant is discharged from the compressor 1 to the radiator 2.

The discharge chamber VB fulfills a function of a space absorbing pressure pulsation of the high-pressure refrigerant discharged from the high-pressure discharge hole 13*d*, and fulfills a function of a refrigerator-oil separation device that separates the refrigerator oil from the high-pressure refrigerant discharged from the high-pressure discharge hole 13*d* and accumulates the refrigerator oil downward. The refrigerator oil accumulated in a lower side of the discharge chamber VB is supplied to each sliding portion of the compressor 1 through the oil supply passage 25*c* provided in the shaft 25.

Next, operations of the compressor 1 and the refrigeration cycle 100 of the present embodiment in the above-described configuration will be described. When an electric power is supplied to the electric motor portion 20 of the compressor 1 to rotate the rotor 22 and the shaft 25, the movable scroll 11 is set in orbital motion (revolution motion) about the shaft 25. Accordingly, the low-stage compression chamber VL of the low-stage compression mechanism and the high-stage compression chamber VH of the high-stage compression mechanism rotationally move to with reducing in volume.

In the low-stage compression mechanism, the low-pressure refrigerant drawn into the low-stage compression chamber VL through the low-pressure suction port 12*c* of the low-stage fixed scroll 12 is compressed to be the intermediate-pressure refrigerant and discharged to the accommodation chamber VA through the intermediate-pressure discharge hole 12*d*.

Figure 5:
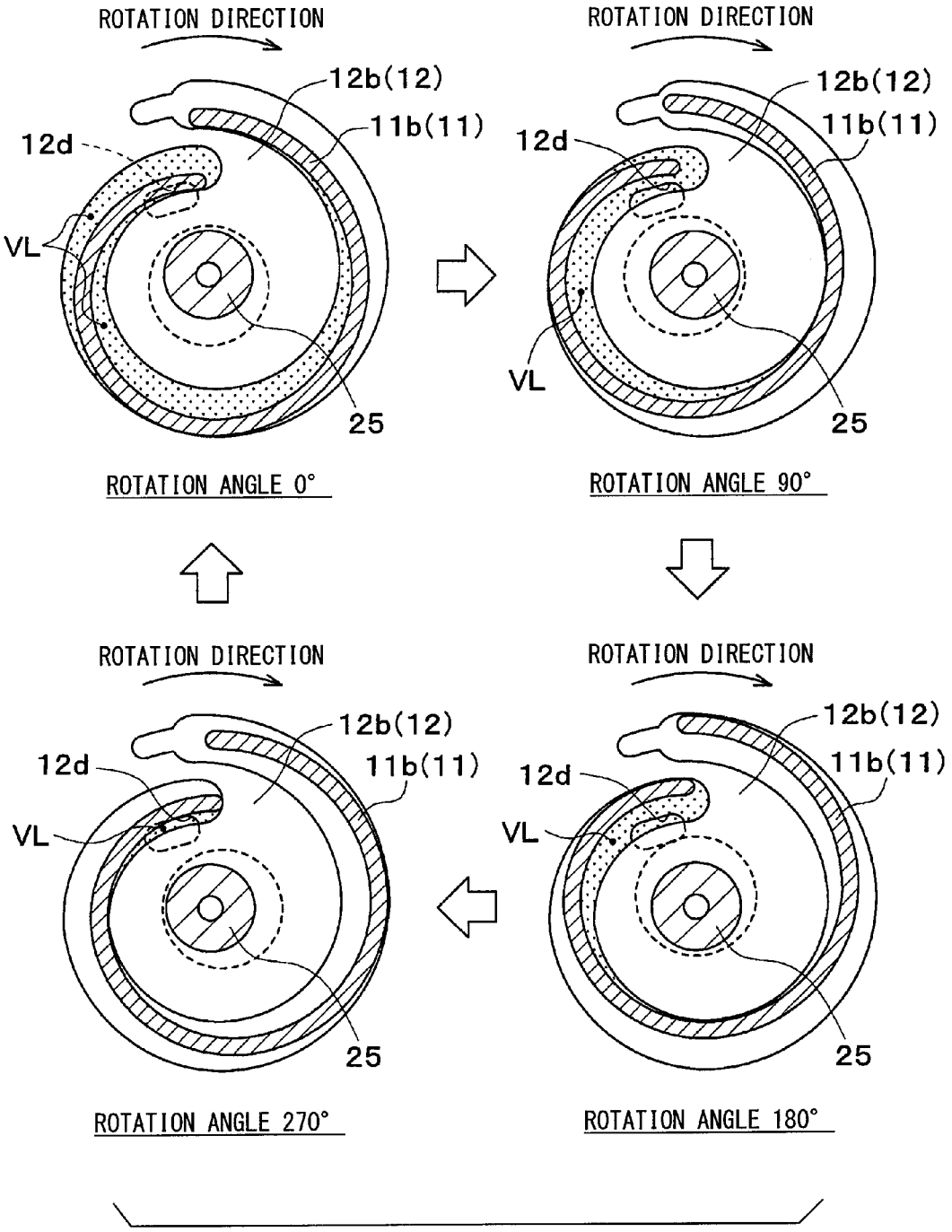
FIG. 5 is a diagram showing a change of a low-stage compression chamber in accordance with rotational motion of a movable scroll according to the embodiment.

More specifically, as described above, the number of curling of the low-stage movable tooth portion 11*b* of the present embodiment is one. Thus, as shown in FIG. 5, a position of the movable scroll 11 immediately after communication with the low-pressure suction port 12*c* is defined as a rotation angle of 0°. At this position, as shown by the dot hatching, the low-stage compression chamber VL is constituted by two low-stage compression spaces which are present on a radially inner side and a radially outer side of the low-stage movable tooth portion 11*b* (Rotation Angle 0° of FIG. 5).

From this position, the movable scroll 11 rotationally moves, and the two low-stage compression spaces communicate with each other on a side of the radially innermost part (curling start part) of the low-stage movable tooth portion 11*b*. The low-stage compression chamber VL is constituted by the single low-stage compression space (Rotation Angle 90° of FIG. 5). When the movable scroll 11 further rotates, a volume of the low-stage compression chamber VL constituted by the above-described single low-stage compression space decreases. The refrigerant in the low-stage compression chamber VL is compressed accordingly to be the intermediate-pressure refrigerant and discharged from the intermediate-pressure discharge hole 12*d* (Rotation Angle 90°→180°→270° in FIG. 5).

Except for a case where the position of the movable scroll 11 is the rotation angle of 0°, when the low-stage compression chamber VL of the present embodiment communicates with the intermediate-pressure discharge hole 12*d*, the low-stage compression chamber VL includes the single space communicating with the intermediate-pressure discharge hole 12*d*. On the other hand, when the movable scroll 11 rotationally moves to be positioned at the rotation angle of 0°, the low-stage compression chamber VL is constituted by the two spaces which are provided asymmetrically about the center axis of the shaft 25. The low-stage compression chamber VL of the present embodiment discharges the refrigerant that is drawn during one revolution of the shaft 25 without making multiple rotations around the axis.

FIG. 5 shows change of the low-stage compression chamber VL, provided between the low-stage movable tooth portion 11*b* and the low-stage fixed tooth portion 12*b* when viewed in the axial direction, in accordance with the rotational displacement of the movable scroll 11.

The intermediate-pressure refrigerant discharged from the intermediate-pressure discharge port 12*d* joins to an intermediate-pressure refrigerant (gas-phase refrigerant flowing out of the gas-liquid separator 4) flowing into the accommodation chamber VA through the intermediate-pressure suction port 32*a* of the motor-side lid member 32. At the same time, the intermediate-pressure refrigerant flows through a gap (i.e. an inner part of the electric motor portion 20) between the stator 21 and the rotor 22, thereby cooling the electric motor portion 20.

The joined refrigerant made of the intermediate-pressure refrigerant discharged from the intermediate-pressure discharge hole 12*d* and the intermediate-pressure refrigerant suctioned from the intermediate-pressure suction port 32*a* is drawn into the high-stage compression chamber VH through the intermediate-pressure refrigerant passage 12*f* and the intermediate-pressure suction port 13*c* of the high-stage fixed scroll 13. The intermediate-pressure refrigerant drawn into the high-stage compression chamber VH is compressed to be a high-pressure refrigerant and discharged from the high-pressure discharge hole 13*d*.

The number of curling of the high-stage movable tooth portion 11*c* of the present embodiment is one, and the low-stage movable tooth portion 11*b* is positioned differently from the high-stage movable tooth portion 11*c* by 180° in phase in the circumferential direction.

Therefore, similar to the low-stage compression chamber VL described in FIG. 5, except for a case where the position of the movable scroll 11 is the rotation angle of 180°, when the high-stage compression chamber VH communicates with the high-pressure discharge hole 13*d*, the high-stage compression chamber VH includes a single space communicating with the high-pressure discharge hole 13*d*. On the other hand, when the movable scroll 11 rotationally moves to be positioned at the rotation angle of 180°, the high-stage compression chamber VH is constituted by two spaces which are provided asymmetrically about the center axis of the shaft 25. The high-stage compression chamber VH of the present embodiment discharges the refrigerant that is drawn during one revolution of the shaft 25 without making multiple rotations around the axis.

The high-pressure refrigerant discharged from the high-pressure discharge hole 13*d* flows into the discharge chamber VB and collides with an inner wall surface inside the discharge chamber VB. Accordingly, a flow speed of the high-pressure refrigerant reduces, and the refrigerator oil contained in the high-pressure refrigerant falls downward due to the action of gravity and accumulated. The high-pressure refrigerant from which the refrigerator oil has been separated is discharged from the high-pressure discharge port 33*a* of the compression-mechanism-side lid member 33.

In the refrigeration cycle 100, the high-pressure refrigerant discharged from the high-pressure discharge port 33*a* of the compressor 1 flows into the radiator 2 and radiates heat via heat exchange with the blown air that is to be blown into the air-conditioning target space. Accordingly, the blown air is heated. The refrigerant flowing out of the radiator 2 is depressurized to be the intermediate-pressure refrigerant in the high-stage expansion valve 3, and flows into the gas-liquid separator 4.

The liquid-phase refrigerant separated in the gas-liquid separator 4 is depressurized to be the low-pressure refrigerant in the low-stage expansion valve 5, and flows into the evaporator 6. The refrigerant flowing into the evaporator 6 evaporates by absorbing heat from outside air. The refrigerant flowing out of the evaporator 6 is suctioned into the low-pressure refrigerant suction port 11*d* of the compressor 1 and is compressed newly. On the other hand, the gas-phase refrigerant separated in the gas-liquid separator 4 is suction into the intermediate-pressure suction port 32*a* of the compressor 1, and is compressed newly.

The refrigeration cycle 100 of the present embodiment can be operated as described above, and the interior blown air can be heated in the air conditioner. Further, according to the compressor 1 of the present embodiment, the low-stage compression mechanism and the high-stage compression mechanism are arranged in proximity to opposite sides of the movable substrate portion 11*a* of the movable scroll 11, respectively. Hence, the size of the compressor can be reduced as a whole.

In addition, in the compressor 1 of the present embodiment, the shaft 25 is disposed to extend through the center part of the low-stage fixed scroll 12 and the center part of the movable scroll 11, and both end parts of the shaft 25 are rotatably supported by the electric-motor-side bearing portion 25*a* and the compression-mechanism-side bearing portion 25*b*.

In such configuration (both end support) where the both end parts of the shaft 25 are rotatably supported, a largest rotation rate below which the shaft 25 can be rotated stably can be increased higher than that in a configuration (one end support) where only one end part of the shaft 25 is rotatably supported. Therefore, in the compressor 1 of the present embodiment, a maximum volume of the compression chamber of each compression mechanism that is necessary for discharging a fluid at a desired flow rate can be reduced, and the size can be further reduced.

In a general scroll compression mechanism in which a shaft (rotation shaft) does not extend through a center part of a movable scroll, crescent-shaped compression spaces are present in multiple positions when viewed in a rotation shaft direction. Further, these multiple compression spaces are symmetric about the center axis of the rotation shaft, and revolve with moving from a radially outer side to a radially inner side and reducing in volume in accordance with an orbital motion of the movable scroll.

When tow compression spaces symmetric with each other about the center axis move to a radially inner most side (center axis side), the two compression spaces communicate with each other, and fluid compressed in the two compression spaces is discharged from a discharge hole provided in a center part of a fixed scroll.

However, in a configuration like the scroll-type compressor of the present embodiment, in which the shaft 25 is arranged to extend through the center part of the low-stage fixed scroll 12 and the center part of the movable scroll 11, two low-stage compression spaces or two high-stage compression spaces cannot be made in communication with each other on the center axis side.

Hence, in order to discharge fluid pressurized in each compression space, refrigerants pressurized in the respective compression spaces have to be joined with each other before the multiple compression spaces moves to the center axis side. In this case, if a pressure difference is produced between the refrigerants in the respective compression spaces, the refrigerant flows backward from the compression space higher in pressure to the compression space lower in pressure. This may cause an energy loss of the compressor to increase.

In contrast, in the compressor 1 of the present embodiment, the number of curling of both the low-stage movable tooth portion 11*b* and the high-stage movable tooth portion 11*c* are set to be one. Thus, as described referring to FIG. 5, the low-stage compression chamber VL communicating with the intermediate-pressure discharge hole 12*d* can be constituted by the single space. Similarly, the high-stage compression chamber VH communicating with the high-pressure discharge hole 13*d* can be constituted by the single space.

Since the refrigerant is discharged from the low-stage compression chamber VL and the high-stage compression chamber VH each of which is configured by a single space, it is not necessary to combine refrigerants pressurized in multiple spaces. Thus, an energy loss produced at the time of combining refrigerants different in pressure can be limited certainly. Therefore, according to the compressor 1 of the present embodiment, in the scroll-type compressor pressurizing refrigerant in multiple stages, an increase in energy loss can be reduced with simple configuration.

Further, in a general gas injection cycle used for an air conditioner, a maximum pressure of a high-pressure refrigerant is approximately from 1.5 to 3 MPa. Thus, like the compressor 1 of the present embodiment, even when the numbers of curling of both the low-stage movable tooth portion 11*b* and the high-stage movable tooth portion 11*c* are set to be one, a practically sufficient pressurizing performance can be provided.

In the compressor 1 of the present embodiment, the low-stage movable tooth portion 11*b* and the high-stage tooth portion 11*c* are positioned to be displaced from each other by 180° in the circumferential direction with respect to the center axis. Therefore, the variation amplitude of the total torque variation can be reduced.

Figure 6:
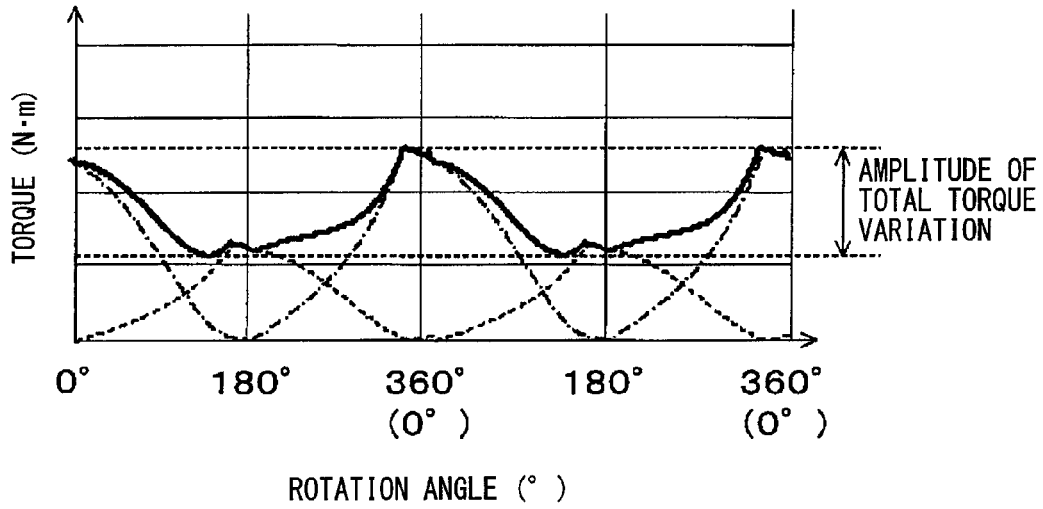
FIG. 6 is a diagram showing a torque variation of the compressor according to the embodiment.
Figure 7:
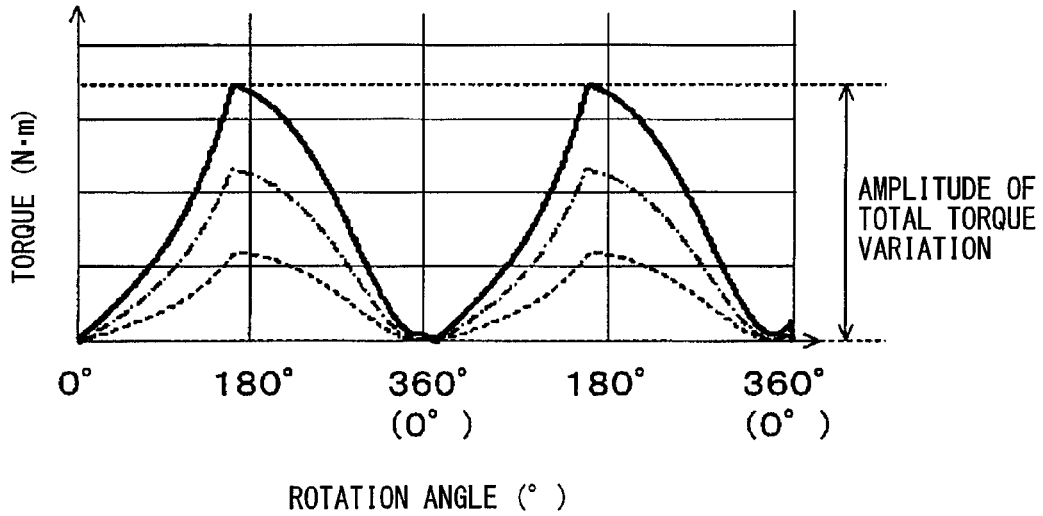
FIG. 7 is a diagram showing a torque variation of a compressor according to a comparative example of the present disclosure.

Specifically, according to study of the inventors, as shown in FIGS. 6 and 7, it is found that the variation amplitude of the total torque variation in the compressor 1 of the present embodiment (refer to FIG. 6) is reduced to be less than 50% of a variation amplitude of a total torque variation in a compressor according to a comparative example in which a phase of a low-stage movable tooth portion 11*b* and a phase of a high-stage movable tooth portion 11*c* are the same as each other (refer to FIG. 7).

In FIGS. 6 and 7, in accordance with rotation of the movable scroll 11, a torque variation generated in the shaft 25 due to pressure variation of refrigerant in the low-stage compression chamber VL is shown by a dashed line, and a torque variation generated in the shaft 25 due to pressure variation of refrigerant in the high-stage compression chamber VH is shown by an alternate long and short dashed line. The total torque variation is shown by a bold solid line.

In the present embodiment, it is described as an example that the low-stage movable tooth portion 11*b* and the high-stage movable tooth portion 11*c* are shifted by 180° in the circumferential direction from each other such that the variation amplitude of the total torque variation approaches the minimum value. However, without limiting to 180°, such total-torque-variation reducing effect can be obtained by positioning the low-stage movable tooth portion 11*b* and the high-stage movable tooth portion 11*c* in different phase.

(Other Embodiments)

The present disclosure is not limited to the above-described embodiment, and can be variously modified as below without departing from the scope of the present disclosure.

(1) In the above-described embodiment, it is described as an example that the multiple-stage-pressurization scroll-type compressor 1 according to the present disclosure is used for the refrigeration cycle 100 of the air conditioner, but the usage of the scroll-type compressor 1 of the present disclosure is not limited to this. Hence, the scroll-type compressor 1 of the present disclosure is usable for a wide range of usage as a compressor which compresses various fluids.

Moreover, the scroll-type compressor 1 may be used for a gas injection cycle. The gas injection cycle includes a compressor compressing and discharging a refrigerant, a radiator causing a high-pressure refrigerant discharged from the compressor to exchange heat with blown air (or outside air), a branch portion in which a flow of the high-pressure refrigerant flowing out of the radiator is branched, a high-stage expansion valve depressurizing one high-pressure refrigerant branched in the branch portion to be an intermediate-pressure refrigerant, an inner heat exchanger causing another high-pressure refrigerant branched in the branch portion to exchange heat with the intermediate-pressure refrigerant depressurized in the high-stage expansion valve, a low-stage expansion valve depressurizing the high-pressure refrigerant flowing out of the inner heat exchanger to be low-pressure refrigerant, and an evaporator causing the low-pressure refrigerant flowing out of the low-stage expansion valve to evaporate by heat exchange between the low-pressure refrigerant and outside air (or blown air). The intermediate-pressure refrigerant flowing out of the inner heat exchanger is drawn into the intermediate-pressure suction port 32*a*, and the low-pressure refrigerant flowing out of the evaporator is drawn into the low-pressure suction port 12*c* of the compressor 1.

(2) In the above-described embodiment, the refrigeration cycle 100 is used for the air conditioner and for heating of the blown air, but may be used for cooling of the blown air. In this case, the radiator 2 may be used as an exterior heat exchanger that performs heat exchange between the refrigerant and the outside air, and the evaporator 6 may be used as a using heat exchanger that cools the blown air.

Additionally, a refrigerant-circuit switching device which switches a refrigerant circuit may be provided, and a heat exchanger used as the using heat exchange or the exterior heat exchanger may be switched between the radiator 2 and the evaporator 6.

Since the gas injection cycle can be improved in COP more than a general refrigeration cycle, it is effective to apply the refrigeration cycle using the scroll-type compressor 1 of the present disclosure to an air conditioner of an electric vehicle or a hybrid vehicle. The electric vehicle cannot use waste heat of an engine (internal combustion engine) for heating of a vehicle compartment. The hybrid vehicle is unlikely to use waste heat of an engine for heating of a vehicle compartment.

(3) In the above-described embodiment, it is described as an example that the numbers of curling of both the low-stage movable tooth portion 11*b* and the high-stage movable tooth portion 11*c* are set to be one. However, the both numbers of curling may be lower than one, or either one of the numbers of curling may be lower than one.

Similarly, in the above-described embodiment, it is described as an example that the low-stage compression chamber VL has the single space that communicates with the intermediate-pressure discharge hole 12*d* when the low-stage compression chamber VL communicates with the intermediate-pressure discharge hole 12*d*, and the high-stage compression chamber VH has the single space that communicates with the high-pressure discharge hole 13*d* when the high-stage compression chamber VH communicates with the high-pressure discharge hole 13*d*. However, either the low-stage compression chamber VL or the high-stage compression chamber VH may have the single space that communicates with the discharge hole 12*d* or 13*d* when communicating with the discharge hole 12*d* or 13*d* through which a fluid is discharged from the low-stage compression chamber VL or the high-stage compression chamber VH.

(4) In the above-described embodiment, it is described as an example that the low-stage compression mechanism of the compression mechanism portion 10 is positioned on a side adjacent to the electric motor portion 20, and the high-stage compression mechanism of the compression mechanism portion 10 is positioned on a side opposite from the electric motor portion 20. However, the positions of the low-stage compression mechanism and the high-stage compression mechanism are not limited to this. The high-stage compression mechanism of the compression mechanism portion 10 may be positioned on the side adjacent to the electric motor portion 20, and the low-stage compression mechanism of the compression mechanism portion 10 may be positioned on the side opposite from the electric motor portion 20.

(5) In the refrigeration cycle 100 of the above-described embodiment, it is described as an example that the subcritical refrigeration cycle is provided, in which the pressure of refrigerant discharged from the compressor 1 does not exceed the critical pressure of the refrigerant. However, for example, carbon dioxide is used as the refrigerant, and a supercritical refrigeration cycle may be provided, in which the pressure of refrigerant discharged from the compressor 1 exceeds the critical pressure of the refrigerant.

What is claimed is:

1. A scroll-type compressor comprising:

a rotation shaft rotating by receiving a drive force from a rotational drive source;

a movable scroll revolving by a rotational drive force transmitted from the rotation shaft, the movable scroll including a movable substrate portion having a flat-plate shape, a low-stage movable tooth portion having a spiral shape and protruding from the movable substrate portion to a first side in an axial direction of the rotation shaft, and a high-stage movable tooth portion having a spiral shape and protruding from the movable substrate portion to a second side in the axial direction of the rotation shaft;

a low-stage fixed scroll including a low-stage substrate portion having a flat-plate shape, and a low-stage fixed tooth portion having a spiral shape, protruding from the low-stage substrate portion in the axial direction of the rotation shaft and engaging with the low-stage movable tooth portion;

a high-stage fixed scroll including a high-stage substrate portion having a flat-plate shape, and a high-stage fixed tooth portion having a spiral shape, protruding from the high-stage substrate portion in the axial direction of the rotation shaft and engaging with the high-stage movable tooth portion;

a low-stage compression chamber that is a space provided between the low-stage movable tooth portion and the low-stage fixed tooth portion, the low-stage compression chamber changing in volume in accordance with revolution of the movable scroll to pressurize a fluid sucked from an outside; and a high-stage compression chamber that is a space provided between the high-stage movable tooth portion and the high-stage fixed tooth portion, the high-stage compression chamber changing in volume in accordance with revolution of the movable scroll to pressurize the fluid pressurized in the low-stage compression chamber, wherein the rotation shaft extends through the movable substrate portion, and a number of curling of at least one of the low-stage movable tooth portion and the high-stage movable tooth portion is less than or equal to one.

2. The scroll-type compressor according to claim 1, wherein the number of curling of both the low-stage movable tooth portion and the high-stage movable tooth portion is less than or equal to one.

3. The scroll-type compressor according to claim 2, wherein the low-stage movable tooth portion and the high-stage movable tooth portion are arranged such that a variation amplitude of a total torque variation obtained by summing a torque variation generated in the shaft due to a fluid in the low-stage compression chamber and a torque variation generated in the shaft due to a fluid in the high-stage compression chamber becomes smaller than that in a case where the low-stage movable tooth portion and the high-stage movable tooth portion are arranged in the same phase when viewed in the axial direction of the shaft.

4. The scroll-type compressor according to claim 3, wherein the low-stage movable tooth portion and the high-stage movable tooth portion are arranged to be displaced from each other by 180° in phase in a circumferential direction with respect to a center axis when viewed in the axial direction of the rotation shaft.

5. A scroll-type compressor comprising:

a rotation shaft rotating by receiving a drive force from a rotational drive source;

a movable scroll revolving by a rotational drive force transmitted from the rotation shaft, the movable scroll including a movable substrate portion having a flat-plate shape, a low-stage movable tooth portion having a spiral shape and protruding from the movable substrate portion to a first side in an axial direction of the rotation shaft, and a high-stage movable tooth portion having a spiral shape and protruding from the movable substrate portion to a second side in the axial direction of the rotation shaft;

a low-stage fixed scroll including a low-stage substrate portion having a flat-plate shape, and a low-stage fixed tooth portion having a spiral shape, protruding from the low-stage substrate portion in the axial direction of the rotation shaft and engaging with the low-stage movable tooth portion;

a high-stage fixed scroll including a high-stage substrate portion having a flat-plate shape, and a high-stage fixed tooth portion having a spiral shape, protruding from the high-stage substrate portion in the axial direction of the rotation shaft and engaging with the high-stage movable tooth portion;

a low-stage compression chamber that is a space provided between the low-stage movable tooth portion and the low-stage fixed tooth portion, the low-stage compression chamber changing in volume in accordance with revolution of the movable scroll to pressurize a fluid sucked from an outside; and a high-stage compression chamber that is a space provided between the high-stage movable tooth portion and the high-stage fixed tooth portion, the high-stage compression chamber changing in volume in accordance with revolution of the movable scroll to pressurize the fluid pressurized in the low-stage compression chamber, wherein the rotation shaft extends through the movable substrate portion, and at least one of the low-stage compression chamber and the high-stage compression chamber has a single space communicating with a discharge hole when communicating with the discharge hole through which a fluid is discharged from an inside of each compression chamber.

6. The scroll-type compressor according to claim 5, wherein at least one of the low-stage compression chamber and the high-stage compression chamber has a plurality of compression spaces when the rotation shaft rotates, and the plurality of compression spaces are arranged asymmetrically about a center axis of the rotation shaft.

7. The scroll-type compressor according to claim 5, wherein the discharge hole includes an intermediate-pressure discharge hole provided in the low-stage fixed scroll to cause the fluid to flow out of an inside of the low-stage compression chamber, and a high-pressure discharge hole provided in the high-stage fixed scroll to cause the fluid to flow out of an inside of the high-stage compression chamber, the low-stage compression chamber has a single space communicating with the intermediate-pressure discharge hole when communicating with the intermediate-pressure discharge hole, and the high-stage compression chamber has a single space communicating with the high-pressure discharge hole when communicating with the high-pressure discharge hole.

8. The scroll-type compressor according to claim 7, wherein the low-stage movable tooth portion and the high-stage movable tooth portion are arranged such that a variation amplitude of a total torque variation obtained by summing a torque variation generated in the shaft due to a fluid in the low-stage compression chamber and a torque variation generated in the shaft due to a fluid in the high-stage compression chamber becomes smaller than that in a case where the low-stage movable tooth portion and the high-stage movable tooth portion are arranged in the same phase when viewed in the axial direction of the shaft.

9. The scroll-type compressor according to claim 8, wherein the low-stage movable tooth portion and the high-stage movable tooth portion are arranged to be displaced from each other by 180° in phase in a circumferential direction with respect to a center axis when viewed in the axial direction of the rotation shaft.

* * * * *